US012704328B2

(12) United States Patent
Cline et al.

(10) Patent No.: US 12,704,328 B2
(45) Date of Patent: Aug. 11, 2026

(54) COLD CLIMATE HEAT PUMP SYSTEM WITH ENERGY STORAGE

(71) Applicant: TRANE INTERNATIONAL INC., Davidson, NC (US)

(72) Inventors: Lee R. Cline, West Salem, WI (US); Richard M. Heiden, Holman, WI (US); Brian J. Fiegen, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 132 days.

(21) Appl. No.: 18/591,419

(22) Filed: Feb. 29, 2024

(65) Prior Publication Data

US 2025/0277633 A1 Sep. 4, 2025

(51) Int. Cl.
*F28D 20/00* (2006.01)

(52) U.S. Cl.
CPC ..... *F28D 20/0034* (2013.01)

(58) Field of Classification Search
CPC ..... F28D 20/0034; F24D 19/0095; F24D 2220/02; F24H 15/136; F24H 15/156; F24H 15/16; F24H 15/375; F24F 2221/54
USPC ..... 165/10
See application file for complete search history.

(56) References Cited

U.S. PATENT DOCUMENTS

| | | | |
|---|---|---|---|
| 4,294,078 | A | 10/1981 | MacCracken |
| 5,497,629 | A | 3/1996 | Rafalovich et al. |
| 5,680,898 | A | 10/1997 | Rafalovich et al. |
| 6,668,567 | B2 | 12/2003 | Levenduski et al. |
| 8,950,203 | B2 | 2/2015 | Giertz |
| 10,487,302 | B2 | 11/2019 | Spangenburg et al. |
| 10,900,667 | B2 | 1/2021 | Field et al. |
| 10,907,848 | B2 | 2/2021 | Wallace |
| 11,067,296 | B2 | 7/2021 | Callemo et al. |
| 11,624,532 | B2 | 4/2023 | Ryu et al. |
| 2010/0242517 | A1 | 9/2010 | Johnson |
| 2011/0083462 | A1 | 4/2011 | Engelhart et al. |
| 2013/0205824 | A1 | 8/2013 | Morimoto et al. |
| 2014/0260361 | A1 | 9/2014 | Rodier |
| 2014/0262146 | A1 | 9/2014 | Cline et al. |
| 2019/0148946 | A1 | 5/2019 | Yoshimoto et al. |

(Continued)

FOREIGN PATENT DOCUMENTS

| | | | |
|---|---|---|---|
| EP | 2159495 A1 * | 3/2010 | ..... F24D 11/0228 |
| EP | 2463591 B1 | 11/2013 | |

(Continued)

OTHER PUBLICATIONS

Office action issued in U.S. Appl. No. 18/336,976, Mar. 7, 2024 (17 pages).

(Continued)

*Primary Examiner* — Steve S Tanenbaum
(74) *Attorney, Agent, or Firm* — HSML P.C.

(57) ABSTRACT

A heat pump system for a building can include thermal energy storage tanks, a first air source heat pump for providing energy to the system, a second air source heat pump for providing energy to the system under cold climate conditions, and an additional heat source for supporting defrost operations and/or to provide energy under extreme cold conditions. The system can further include a controller configured to provide efficient use of energy sources to meet heating demands under extreme cold conditions.

18 Claims, 2 Drawing Sheets

(56) References Cited

U.S. PATENT DOCUMENTS

| | | | | |
|---|---|---|---|---|
| 2020/0182558 | A1 | 6/2020 | Alsadah et al. | |
| 2020/0393170 | A1 | 12/2020 | Murphy et al. | |
| 2021/0156601 | A1 | 5/2021 | Melink et al. | |
| 2022/0042718 | A1 | 2/2022 | Liu et al. | |
| 2022/0205686 | A1* | 6/2022 | MacCracken | F25D 16/00 |
| 2023/0332807 | A1 | 10/2023 | MacCracken et al. | |

FOREIGN PATENT DOCUMENTS

| | | | | |
|---|---|---|---|---|
| EP | 3252383 | A1 | 12/2017 | |
| EP | 3354996 | A1 | 8/2018 | |
| EP | 3546839 | B1 | 1/2021 | |
| EP | 4261472 | A1 | 10/2023 | |
| GB | 2578022 | A * | 4/2020 | F25B 25/005 |
| WO | 2020/209979 | A2 | 10/2020 | |

OTHER PUBLICATIONS

Extended European Search Report, European Patent Application No. 25160527.5, Aug. 19, 2025, (14 pages).
Extended European Search Report issued in European Patent Application No. 21215001.5, May 24, 2022 (8 pages).

* cited by examiner

COLD CLIMATE HEAT PUMP SYSTEM WITH ENERGY STORAGE

FIELD

This disclosure is directed to heat pump circuits, particularly heat pump circuits including a cold climate heat pump and thermal storage, and the operation thereof.

BACKGROUND

Typical air source heat pumps suffer from diminished capacity and/or efficiency at low temperatures, and typically cannot support heating loads when ambient temperatures are below zero degrees Fahrenheit. Heat recovery is restricted to times when there are cooling loads as well as heating loads, which can be limited, especially during extreme low ambient temperatures. Further, fossil fuel boilers contribute carbon emissions, and electric resistance heating significantly increases electrical demand if relied on to fully service heating loads.

SUMMARY

This disclosure is directed to heat pump circuits, particularly heat pump circuits including a cold climate heat pump and thermal storage, and the operation thereof.

By including an additional cold climate air source heat pump, systems can provide heating even outside the typical heating envelope for standard heat pump systems. The use of the cold climate air source heat pump can be supported by the use of thermal storage, a standard heat pump, and/or additional boilers. These various components can be arranged and controlled in concert to improve or optimize the efficiency of heating operations over a larger temperature window. For example, boilers can reduce the lift required from heat pumps. Thermal storage can allow heat recovery to be decoupled from heating demand, such that heat can be stored for later utilization. Thermal storage can also allow energy efficient sources to be used for charging opportunistically based on ambient conditions, energy costs and carbon production, and the like. Examples of such efficient charging can include continuous low-level charging of the thermal storage, charging thermal storage based on energy costs, and the like. By using the air source heat pump to balance the heating and cooling loads of the storage source heat pump circuit, the system can be operated without further requiring a cooling tower, which may not be available in some climates or some installation sites.

In an embodiment, a heat pump system includes a storage source energy transfer circuit comprising one or more thermal energy storage tanks, the storage source energy transfer circuit configured to circulate a process fluid. The heat pump system further includes a heating distribution circuit configured to circulate a heating fluid to a heating load such that the heating fluid provides heating at the heating load when in an operational mode including heating. The heat pump system also includes a cooling distribution circuit configured to circulate a fluid to a cooling load such that said fluid provides cooling at the cooling load when in an operational mode including cooling. The heat pump system includes one or more chiller-heaters each configured to transfer heat from the process fluid to the heating fluid so as to heat the heating fluid and cool the process fluid. The heat pump system further includes an air source heat pump circuit including an air source heat pump configured to transfer heat from an ambient environment to the process fluid.

In an embodiment, the heat pump system further includes a second air source heat pump circuit configured to exchange heat with the heating distribution circuit.

In an embodiment, the fluid circulated by the cooling distribution circuit the process fluid. In an embodiment, the heat pump system further includes one or more fluid lines configured such that the process fluid can be circulated from the air source heat pump circuit directly to the cooling distribution circuit.

In an embodiment, the air source heat pump circuit further includes a boiler. In an embodiment, the boiler is in series with the air source heat pump, and the boiler is configured to be operated during a defrost operation of the air source heat pump.

In an embodiment, the air source heat pump circuit further comprises a second air source heat pump, the second air source heat pump being a cold climate heat pump configured to provide energy to transfer heat from the ambient environment to the process fluid when an ambient temperature is below 0° Fahrenheit.

In an embodiment, the heat pump system further includes a controller configured to perform charging of the one or more thermal energy storage tanks based on an ambient temperature and a cost of electrical energy, wherein performing charging includes selecting one or more heat sources from the air source heat pump, the second air source heat pump, and one or more boilers. In an embodiment, performing charging further includes determining a timing for operating at least one of the one or more heat sources.

In an embodiment, the system further includes a heat recovery chiller configured to exchange energy between the fluid of the cooling distribution circuit and the heating fluid.

In an embodiment, the heating distribution circuit further comprises a boiler configured to supply heat to the heating fluid.

In an embodiment, the system further includes a controller configured to control operation of the air source heat pump based on a temperature of the process fluid.

In an embodiment, a method of charging thermal storage in a storage source heat pump system further includes a first air source heat pump obtaining, at a controller, ambient conditions and obtaining, at the controller, a cost of energy. The method further includes determining, using the controller, a cost of adding or removing heat from the thermal storage of the heat pump system based on the ambient conditions, the cost of energy, and performance characteristics of the heat pump system. The method also includes determining, based on the cost of adding heat to the thermal storage, whether to add or remove heat from the thermal storage. When it is determined to add or remove heat to the thermal storage, operating the heat pump system so as to add or remove the heat from the thermal storage.

In an embodiment, the method further includes determining operating parameters for operating the heat pump system so as to add or remove heat to the thermal storage, wherein the operating parameters include a time at which to operate the first air source heat pump of the heat pump system, and a capacity at which to operate the first air source heat pump.

In an embodiment, the storage source heat pump system further includes a second air source heat pump, the second air source heat pump configured to provide heat at ambient temperatures between 0° F. and −30° F., and determining the cost of adding or removing heat includes determining a first cost of adding heat using the first air source heat pump and a second cost of adding heat using the second air source heat pump.

In an embodiment, the storage source heat pump system further includes a boiler, and wherein determining the cost of adding or removing heat includes determining a first cost of adding heat using the first air source heat pump and a second cost of adding heat using the boiler. In an embodiment, the boiler is an electric boiler. In an embodiment, the boiler is a fossil fuel boiler.

In an embodiment, a method of defrosting an air source heat pump of a storage source heat pump system includes operating a boiler so as to temper a process fluid temperature of the storage source heat pump system during a defrost operation of said air source heat pump, wherein the boiler is in parallel with the air source heat pump with respect to flow of a process fluid of the storage source heat pump system. In an embodiment, the boiler is an electric boiler.

DRAWINGS

DETAILED DESCRIPTION

This disclosure is directed to heat pump circuits, particularly heat pump circuits including a cold climate heat pump and thermal storage, and the operation thereof. Storage source heat pump systems and operations thereof are also discussed in U.S. Pat. No. 11,680,733, the contents of which are herein incorporated by reference, in their entirety.

Figure 1:
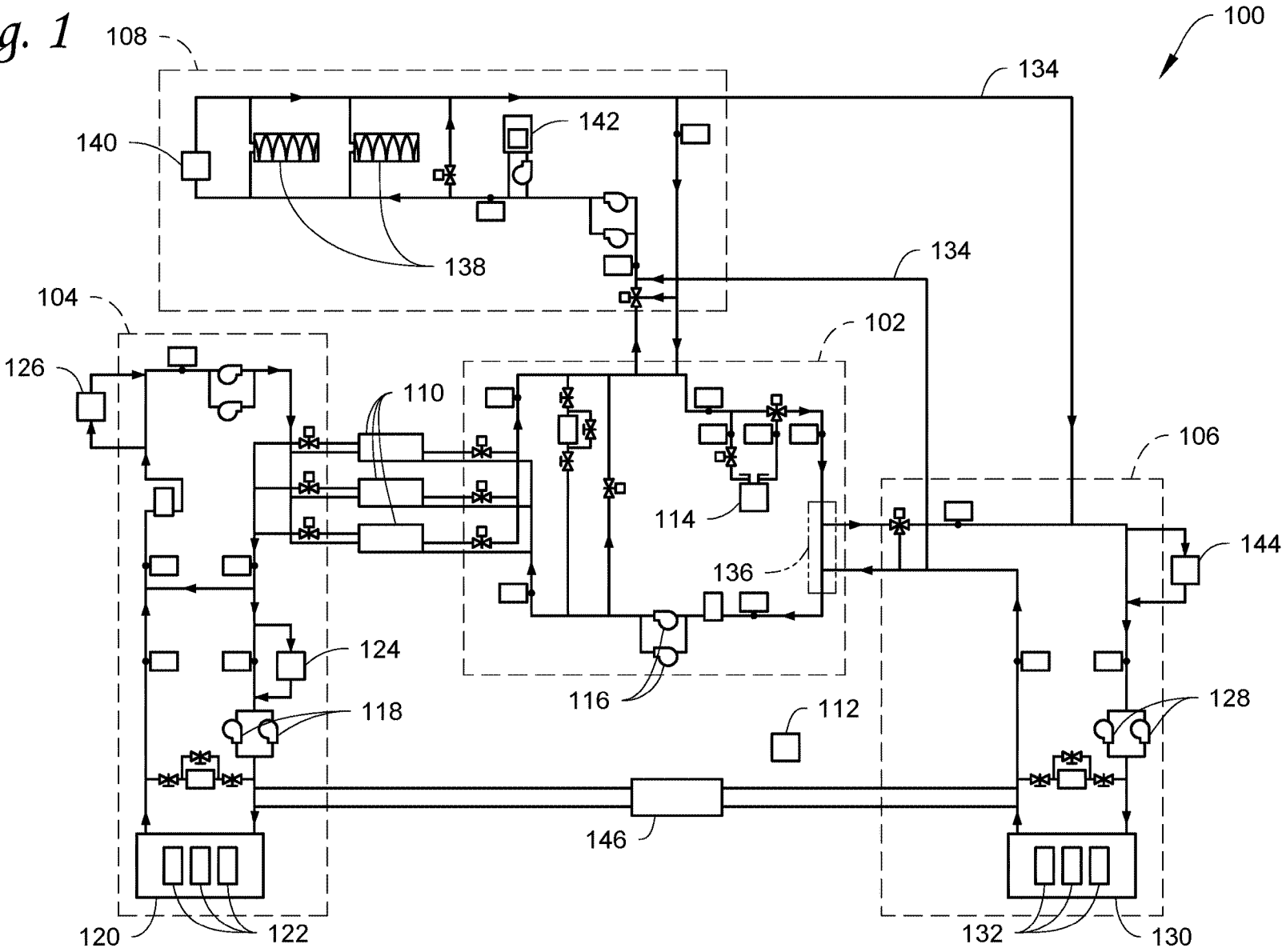
FIG. 1 shows a schematic of a heat pump system according to an embodiment.

FIG. 1 shows a schematic of a heat pump system 100 according to an embodiment. Heat pump system 100 includes storage source energy transfer circuit 102, heating distribution circuit 104, cooling distribution circuit 106, air source heat pump circuit 108, and one or more chiller-heaters 110. A controller 112 can be provided in the heat pump system 100.

Heat pump system 100 is configured to provide heating and cooling to one or more conditioned spaces within a building. The heat pump system 100 can use the storage source energy transfer circuit 102 to transfer chilled water to the cooling distribution circuit to meet cooling demand, to transfer heated water to the chiller-heater(s) to enable meeting of the heating demand, and/or allow for excess heat or cooling energy to be stored in the thermal energy storage for later utilization. In an embodiment, heat pump system 100 can be primarily or entirely electrically powered. The heat pump system 100 can be capable of meeting heating demand in areas having extreme cold, for example reaching ambient temperatures as low as −30° Fahrenheit for some duration of time.

Storage source energy transfer circuit 102 includes one or more thermal energy storage tanks 114 and one or more pumps 116. Storage source energy transfer circuit 102 is configured to circulate a process fluid. Storage source energy transfer circuit 102 can store thermal energy so as to allow temporal decoupling of heating and cooling loads such that heat recovery can be performed even when the respective heating and cooling loads are not simultaneous. By using thermal storage as a source for the chiller-heaters 110 used to supply heat to heating distribution circuit 104, the storage source energy transfer circuit 102 can allow heating capacity and/or the supplied hot water temperatures to be preserved even during periods of extremely low outdoor air temperatures, for example as low as −30° F. Storage of thermal energy in thermal energy storage tanks 114 can further enable the use of more cost-efficient and/or less carbon emitting energy sources to supply heating by allowing the thermal energy storage tanks 114 to be charged at times separate from the occurrence of particular heating or cooling demands. This can allow, for example, use of solar, use of off-peak grid energy to extents not possible at the time of the heating or cooling demand, reduction in the use of fossil fuel or even electric resistance boilers, and the like.

Thermal energy storage tanks 114 are one or more containers, vessels, or the like, each containing a medium. The medium can store energy primarily based on change in temperature in a given state without medium phase change, which can be referred to as sensible energy storage, and/or the medium can be selected to store energy via phase change, which can be referred to as latent energy storage. In the case of latent energy storage the medium can be selected to freeze or thaw at a suitable temperature, such that the latent heat of fusion of the medium allows heating energy to be stored by thawing and/or heating at least some of the medium, and allows cooling capacity to be stored by cooling and/or freezing at least some of the medium. Suitable freezing temperatures can be selected at or near temperatures typical for the process fluid of the storage source energy transfer circuit 102. Non-limiting examples of media for thermal energy storage tanks 114 includes water and water with one or more additives such as glycol to adjust a freezing temperature thereof or other phase-change material. Thermal energy storage tanks 114 can each include a heat exchanger configured to receive the process fluid of storage source energy transfer circuit 102 and exchange heat between the process fluid and the medium contained within the thermal energy tank 114. In embodiments, the storage source energy transfer circuit 102 can be configured with suitable piping and valves to allow one or more of the thermal energy storage tanks 114 to be bypassed and/or to control an amount of flow to the thermal energy tank 114. In an embodiment, the amount of flow to the thermal energy tank 114 can be controlled such that the amount of flow is variable within a range.

Pumps 116 are configured to drive the flow of process fluid within storage source energy transfer circuit 102. Pumps 116 can be one or more pumps in any suitable arrangement, for example being in parallel. The pumps 116 can be variable-flow pumps, or a plurality of pumps that can be staged so as to control the flow rate in storage source energy transfer circuit 102.

Heating distribution circuit 104 includes one or more pumps 118, and circulates a heating fluid to heating load 120. Heating load 120 can optionally include a plurality of terminals 122. The heating distribution circuit 104 can optionally further include a boiler 124. The heating distribution circuit 104 can optionally further include a direct heating heat pump 126. Heating distribution circuit 104 can be, for example, a variable-flow heating circuit including any suitable arrangement of piping and valves. When in a mode including heating, the heating distribution circuit 104 circulates the heating fluid from the one or more chiller-heaters 110, where the heating fluid is heated to a heating supply temperature, to the heating load 120, where the heating fluid releases heat to provide heating, and then returns to the chiller-heaters 110.

Pumps 118 are configured to drive the flow of process fluid within heating distribution circuit 104. Pumps 118 can be one or more pumps in any suitable arrangement, for example being in parallel. The pumps 118 can be variable-flow pumps, or a plurality of pumps that can be staged so as to control the flow rate in heating distribution circuit 104.

Heating load 120 is a heating load to be serviced by heat pump system 100, such as, for example, one or more conditioned spaces within a building. Heating load 120 can be heated by absorbing heat from the heating fluid circulated in heating distribution system 104. In an embodiment, heating load 120 includes a plurality of terminals 122 where the heating fluid can supply heat to the conditioned space. The heating distribution system 104 can include any suitable fluid lines and valves to distribute the heating fluid to terminals 122 within the heating load.

In some embodiments, heating distribution circuit 104 can include one or more boilers 124. Boiler 124 can be any suitable heater for the heating fluid, such as a fossil fuel-powered boiler, an electric resistance boiler, or the like. Boiler 124 can be included in heating distribution circuit 104 using any suitable piping and/or valves, for example to allow boiler 124 to be bypassed when not in use. Boiler 124 can be configured to provide supplemental heating to the heating fluid, for example when the temperature of the heating fluid is below a heating fluid supply temperature threshold, for example when the chiller-heaters 110 are unable to fully heat the heating fluid due to the conditions in the storage source energy transfer circuit 102.

Direct heating heat pump 126 can optionally be included in heating distribution circuit 104. Direct heating heat pump 126 can be an air source heat pump configured to heat the heating fluid using heat from the ambient environment. Direct heating heat pump 126 can be used, for example, to satisfy low-level heating demand without requiring operation of chiller-heaters 110. By directly heating the heating fluid, direct heating heat pump 126 can reduce or avoid parasitic losses. In an embodiment, instead of a separate direct heating heat pump 126, the heating distribution circuit can include suitable fluid connections so as to be directly heated by air source heat pump circuit 108.

Cooling distribution circuit 106 includes one or more pumps 128, and circulates a fluid to a cooling load 130. Cooling load 130 can optionally include a plurality of terminals 132. In an embodiment, the cooling distribution circuit 106 can optionally include direct fluid lines 134 configured to allow process fluid to be conveyed directly from air source heat pump circuit 108 to the cooling distribution circuit 106. Cooling distribution circuit 106 can be a variable-flow cooling distribution circuit, with any suitable arrangement of piping and valves. In an embodiment, the cooling distribution circuit 106 is directly connected to the storage source energy transfer circuit 102, such that cooling distribution circuit 106 receives and circulates the same process fluid as storage source energy transfer circuit 102 and returns said process fluid to the storage source energy transfer circuit 102. In an embodiment, cooling distribution circuit 106 can optionally use a different process fluid from the process fluid of storage source energy transfer circuit 102, with isolation heat exchanger 136 provided to allow the process fluid of the cooling distribution circuit 106 to exchange heat with the process fluid of storage source energy transfer circuit 102.

Cooling distribution circuit 106 is configured to circulate a process fluid to the cooling load 130 such that the process fluid absorbs heat and thereby cools the cooling load 130. Cooling load 130 can include one or more conditioned spaces of a building. In an embodiment, cooling load 130 can include a plurality of terminals 132 located within the conditioned space wherein the process fluid of cooling distribution circuit 106 can exchange heat with air of the conditioned space, thereby providing cooling to cooling load 130.

Direct fluid lines 134 can optionally be included to allow the air source heat pump circuit 108 to circulate fluid directly to the cooling distribution circuit 106. The direct fluid lines 134 can allow air source heat pumps 138 to directly cool the fluid of cooling distribution circuit 106, thereby reducing or avoiding parasitic losses from circulating through other portions of the heat pump system 100, such as storage source energy transfer circuit 102.

Optional isolation heat exchanger 136 can be included when the cooling distribution circuit 106 is decoupled from storage source energy transfer circuit 102 and uses a separate process fluid. In such an embodiment, isolation heat exchanger 136 is a heat exchanger allowing the separate process fluids of the cooling distribution circuit 106 and the storage source energy transfer circuit 102 to exchange heat such that the process fluid of the storage source energy transfer circuit 102 absorbs heat from and thereby cools the process fluid of the cooling distribution circuit 106. The isolation heat exchanger 136 can be connected to the storage source energy transfer circuit 102 and the cooling distribution circuit 106 by any suitable piping and valves, for example such that the isolation heat exchanger 136 can be bypassed in the storage source energy transfer circuit 102 when the heat pump system 100 is not operating in a mode that includes cooling.

In an embodiment, the cooling distribution circuit 106 can optionally include a direct chiller 144 configured to provide direct cooling of the process fluid being circulated in the cooling distribution circuit 106. Optional direct chiller 144 can be any suitable chiller for providing at least a portion of the cooling to meet the demand of the cooling load 130. In an embodiment, the direct chiller 144 can instead be included in air source heat pump circuit 108, for example being in parallel with at least one of the one or more air source heat pumps 138, to provide direct cooling to at least some of the process fluid when said process fluid is being circulated through the air source heat pump circuit 108.

Air source heat pump circuit 108 includes one or more air source heat pumps 138. The air source heat pump circuit can be configured to receive and circulate the process fluid of the storage source energy transfer circuit 102. Air source heat pump circuit 108 can further optionally include a supplemental heating boiler 140 and/or a tempering boiler 142. Air source heat pump circuit 108 is configured to provide a heat source or a heat sink for the process fluid of the storage source energy transfer circuit 102 as required based on heating, cooling, and/or thermal storage charging operations of the storage source energy transfer circuit 102. Air source heat pump circuit 108 allows for charging of the thermal energy storage tanks 114 when suitable by adjusting the temperature of the process fluid of storage source energy transfer circuit 102 upwards or downwards to facilitate thawing, freezing, or maintenance of state of the medium in thermal energy storage tanks 114. The air source heat pump circuit 108 can also provide cooling directly to the cooling distribution circuit 106, for example by way of direct cooling lines 134 or by circulation of the process fluid of storage source energy transfer circuit 102 to the cooling distribution circuit 106. The air source heat pump circuit 108 can support heating operations by adding heat to the process fluid of storage source energy transfer source 102, which is in turn used by the chiller-heaters 110 as a source to add heat to the heating fluid of heating distribution circuit 104.

Air source heat pumps 138 are included in air source heat pump circuit 108. In an embodiment, a plurality of air source heat pumps 138 are included. In an embodiment, at least some of the plurality of air source heat pumps 138 have differing operational characteristics, such as the sizing, operational capacity, operating envelope, or the like. In an embodiment, at least one of the plurality of air source heat pumps 138 is a cold climate air source heat pump adapted for operation at low ambient temperatures, for example from 0° F. to −30° F. In an embodiment, the cold climate air source heat pump is included alongside at least one heat pump configured to operate at ambient temperatures above the low ambient temperatures of the cold climate air source heat pump system, for example at or above 0° F. In an embodiment, air source heat pumps 138 of a plurality of the air source heat pumps 138 can be in parallel with one another. Air source heat pumps 138 can be sized based on the energy required to meet heating or cooling loads over a predetermined period of time, such as a day or the like.

Supplemental heating boiler 140 can be included in air source heat pump circuit 108 to supplement or replace heating provided by the air source heat pumps 138 under certain conditions. For example, supplemental heating boiler 140 can be operated to add heat to the process fluid at temperatures even too low for operation of a cold climate air source heat pump, for example when ambient temperatures are below −30° F. Supplemental heating boiler 140 can also optionally be utilized when at least one of the air source heat pumps 138 is in use, for example when the capacity provided by the air source heat pump(s) 138 in operation are insufficient to meet heating demands of the heat pump system 100. The supplemental heating boiler 140 can be any suitable boiler for heating the process fluid, for example a fossil fuel boiler, and electric boiler such as one using resistance heating, or the like. Supplemental heating boiler 140 can be provided at any suitable position along the air source heat pump system 108, for example being positioned upstream of the air source heat pumps 138, downstream of the air source heat pumps 138, or in parallel with at least one of the air source heat pumps 138. Supplemental heating boiler 140 can be included in air source heat pump circuit 108 such that supplemental heating boiler 140 can be selectively included or excluded in the flow path of the process fluid through air source heat pump circuit 108. A capacity of the supplemental heating boiler 140 can be less than a peak heating demand of the heating load 120.

Tempering boiler 142 can be included in air source heat pump circuit 108. The tempering boiler 142 can be positioned in series with one or more of the air source heat pumps 138, for example upstream of the air source heat pumps 138. The tempering boiler 142 can be any suitable boiler for heating the process fluid, for example a fossil fuel boiler, and electric boiler such as one using resistance heating, or the like. The tempering boiler 142 can be configured to be operated when the air source heat pumps 138 are not in use, for example during at least a portion of a defrost cycle of the air source heat pumps 138, startup of the air source heat pumps 138, or the like. Tempering boiler 142 can be selected to have a heating capacity sufficient to maintain a temperature of the process fluid passing through the air source heat pump circuit 108 when said process fluid bypasses the air source heat pumps 138 at a predetermined ambient temperature. Tempering boiler 142 can be operated so as to maintain a temperature of the process fluid passing through the air source heat pump circuit 108 when said process fluid bypasses the air source heat pumps 138. In an embodiment, the temperature can be maintained by the tempering boiler 142 at levels sufficient to protect the air source heat pumps 138 from damage resulting from receiving too cold of process fluid.

Chiller-heaters 110 are one or more fluid-to-fluid heat pumps configured to use the process fluid of thermal energy transfer circuit 102 to heat the heating fluid of the heating distribution circuit 104 and thereby cool the process fluid of thermal energy transfer circuit 102. Chiller-heaters 110 can each be a non-reversible heat pump, where the process fluid of thermal energy transfer circuit 102 is the lower-energy state from which heat is pumped to further raise a temperature of the higher-energy heating fluid of the heating distribution circuit 104. Chiller-heaters 110 can allow the heating fluid to be heated using energy from thermal energy storage tanks 114 without directly being affected by outdoor ambient temperatures. Additionally, the chiller-heaters 110 allow higher temperatures for the heating fluid compared to the process fluid of thermal energy transfer circuit 102, thus allowing the process fluid to be kept at temperatures closer to a freezing point of the medium used in thermal energy storage tanks 114. Chiller-heaters 110 using the process fluid of thermal energy transfer circuit 102 further allows heating of the heating fluid without interruptions such as defrosting cycles required for air source heat pumps. Additionally, using the chiller-heaters 110 sourced by the process fluid of thermal energy transfer circuit 102 also allows the heating by chiller-heaters to be performed at conditions providing superior coefficients of performance, compared to, for example, operating air source heat pumps at low ambient temperatures. The chiller-heaters 110 can be selected and sized based on the full design heating load associated with heating load 120. The chiller-heaters 110 can include one or more redundancy units to provide backup heating in case of a failure in another chiller-heater. The chiller-heaters 110 can be selected so as to allow staging of the chiller-heaters to efficiently meet different levels of loading.

Optionally, a heat recovery chiller 146 can be provided in heat pump system 100. Heat recovery chiller 146 can be a chiller-heater such as a non-reversible heat pump. Heat recovery chiller 146 can be configured to heat the heating fluid of heating circuit 104, with the source of heat being the process fluid of cooling distribution circuit 106. The heat recovery chiller 146 can be operated during operating modes of heat pump system 100 having simultaneous heating and cooling demands, so as to use heat from the cooling of the cooling load 130 to support heating of the heating load 120, or to support cooling of the cooling load 130 by removing heat that is provided to the heating fluid. Heat recovery chiller 146 can balance or assist in balancing the heating and cooling provided by heat pump system 100 with reduced parasitic losses from flow of process fluids and transfer of heat therebetween in other portions of the heat pump system 100 such as storage source energy transfer circuit 102 or air source heat pump circuit 108.

Controller 112 is configured to control various elements of the heat pump system 100, including chiller-heaters 110, pumps such as pumps 116, 118, optional direct heating heat pump 126, air source heat pumps 138, boilers such as boiler 124, supplemental heating boiler 140, or tempering boiler 142, valves disposed along the various fluid lines, and the like. Controller 112 can receive temperature data for one or more of the fluids circulated in heat pump system 100 by way of temperature sensors disposed along the various fluid lines and/or within any of the equipment. Controller 112 can be connected to any of the various elements, sensors, and the like discussed above through any suitable wired and/or wireless communications connections. Controller 112 can include any suitable processors, memories, input/output devices, and the like. Controller 112 can determine desired temperatures for the various fluids to meet the respective heating and cooling demands and perform charging or utilization of the thermal energy storage tanks 114, and control the various equipment described above to achieve or maintain the desired temperatures for the various fluids.

Controller 112 can control the heat pump system 100 in any suitable heating, cooling or combined heating and cooling mode so as to meet the requirements of heating load 120 and/or cooling load 130. In an embodiment, when heating and cooling are both being performed, the operation of heat pump system 100 can be heating dominant or cooling dominant depending on which demand is greater. In an embodiment, when the heat pump system 100 is in a cooling dominant mode, the air source heat pump circuit 108 can be operated to supplement the cooling so as to balance the operation of heat pump system 100. In an embodiment, when the heat pump system 100 is in the cooling dominant mode, additional cooling can be provided by circulating the process fluid of storage source energy transfer circuit 102 through thermal energy storage tanks 114 to reject heat to the medium contained therein, thereby cooling the process fluid and melting and/or heating some of the medium in said thermal energy storage tanks 114. In an embodiment, when the heat pump system 100 is in a heating dominant mode, the air source heat pump circuit 108 can be operated to supplement the heating so as to balance the operation of heat pump system 100. In an embodiment, when the heat pump system 100 is in the heating dominant mode, additional heating can be provided by circulating the process fluid of storage source energy transfer circuit 102 through thermal energy storage tanks 114 to absorb heat from the medium contained therein, thereby heating the process fluid and freezing and/or cooling some of the medium in said thermal energy storage tanks 114. The extent of the cooling or heating of the process fluid by exchange of heat with the medium in the thermal energy storage tanks 114 can be controlled by controlling an amount or rate of flow of the process fluid through the integral heat exchangers of the thermal energy storage tanks 114.

Controller 112 can further be configured to operate heat pump system 100 so as to suitably charge the thermal energy storage tanks 114, for example by thawing or freezing some of the medium contained therein through control of the temperature(s) in storage source energy transfer circuit 102. Charging of the thermal energy storage tanks 114 can include melting of the medium of thermal energy storage tanks 114 to prepare the thermal energy storage tanks 114 to support heating operations, or freezing of the medium to prepare the thermal energy storage tanks to support cooling operations. Appropriate charging of the thermal energy storage tanks can be made according to user selections, predetermined programs, or automatically based on forecasts for ambient conditions, month of the year, season, or the like, or any other suitable basis for prediction of heating or cooling demands. The charging of the thermal energy storage tanks 114 can include controlled charging over time, such as trickle charging, opportunistic charging based on current or predicted ambient conditions (for example, temperature, solar intensity, and the like), current or projected energy costs, carbon costs of sources of heating or cooling, or the like, and/or other such factors. A non-limiting example of a method of operating the storage source heat pump system to perform charging of the thermal energy storage tanks is described below and shown in FIG. 2.

Figure 2:
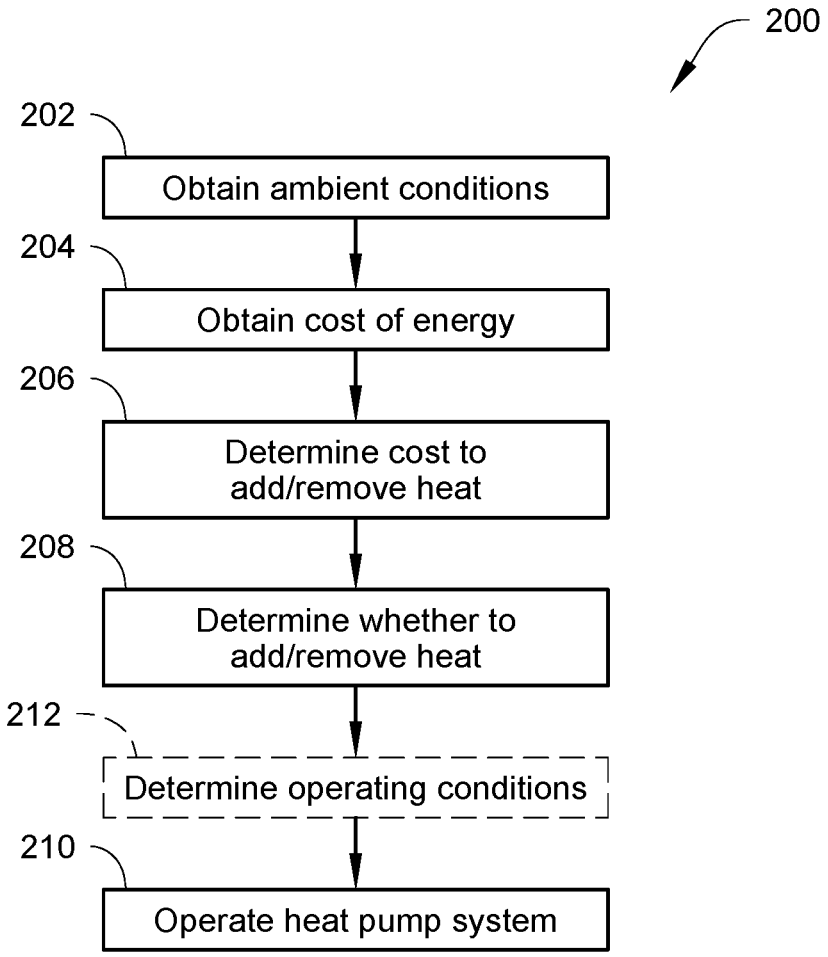
FIG. 2 shows a method of operating a heat pump system according to an embodiment.

FIG. 2 shows a method of operating a storage source heat pump system according to an embodiment. Method 200 includes obtaining ambient conditions at 202, obtaining a cost and/or carbon intensity of energy at 204, determining a cost of adding or removing heat at 206, determining whether to add or remove heat at 208, and operating the heat pump system to add or remove the heat at 210. In an embodiment, the method 200 further includes determining operating parameters for operating the heat pump system 212.

Method 200 can be performed in any suitable storage source heat pump system so as to charge the thermal energy storage tanks in preparation for potential or upcoming heating and/or cooling demands. The method 200 can be carried out, for example, by heat pump system 100 as described above and shown in FIG. 1. The potential or upcoming heating and/or cooling demands can be, for example, target amounts of solid or liquid phase medium in the thermal energy storage tanks or any other suitable measure of the capacity of the thermal energy storage tanks to support heating or cooling operations of the storage source heat pump system. The potential or upcoming heating and/or cooling demands can be based on historical data, particularly recent historical data, forecast data such as temperature and/or solar intensity forecasts, time of year such as month or seasonal, combinations thereof, or the like. Method 200 can be performed continuously or can be triggered based on comparisons of the heating or cooling capacity of the thermal energy storage tanks to threshold levels or any other suitable trigger associated with charging of the thermal energy storage tanks or a need for performing such charging.

Ambient conditions are obtained at 202. The ambient conditions can be environmental conditions affecting the respective heating and cooling demands on the storage source heat pump system and the capacity of the storage source heat pump system to meet said demands, such as temperatures, humidity, solar intensity, or the like. The ambient conditions obtained at 202 can include one or more of current data, historical data, and/or predictive or forecast data. The current data can be, for example, obtained from local sensors, from weather or other services, or the like. The historical data can be, for example, obtained from local sensors, from weather or other services, or the like. The historical data can be selected or trimmed for relevance to current or anticipated demand and capacity, for example being a moving average, data for similar times of previous years, or the like. The predictive or forecast data can be, for example, weather forecasts from a news or forecasting service or the like.

A cost and/or carbon intensity of energy is obtained at 204. The cost and/or carbon intensity of energy can be, for example, a current or predicted cost of electricity (e.g. $/kW-H), a current or predicted estimated emissions per amount of energy (such as a quantity of carbon per unit of energy), or the like. The cost and/or carbon intensity of energy can be obtained at 204 through any suitable means, such as receiving rate information from a utility, communication with a smart meter of the utility, or the like.

A cost of adding or removing heat is determined at 206. The ambient conditions obtained at 202 and the characteristics of the elements of the heat pump system can be used to determine the energy required to perform the adding or removal of heat from the system. The characteristics of the elements of the heat pump system can be, for example, manufacturer specifications stored in a memory, historical performance data, or the like. The characteristics can be used to determine efficiency at the ambient temperatures obtained at 202. The efficiency can be used to determine an amount of energy required to add or remove heat from the system, which can in turn be scaled according to the cost and/or carbon intensity of energy obtained at 204 to determine the cost for adding or removing heat from the thermal energy storage at 206.

Whether to add or remove heat is determined at 208. The determination to add or remove heat from the thermal storage is based on the cost of adding or removing heat determined at 206. In an embodiment, the determination at 208 can be based on a comparison to a predetermined threshold, adding or removing heat when such addition or removal is sufficiently inexpensive and/or environmentally clean. In an embodiment, the determination to add or remove heat can be based on a dynamic threshold, such that adding or removing heat can be performed at relatively optimal opportunities. The dynamic threshold can be based on predicted costs for adding or removing heat based on historical data and/or predictions of ambient conditions and energy costs.

When it is determined to add or remove heat from the thermal storage at 208, the heat pump system is operated to accordingly add or remove heat at 210. The operation can include operation of one or more heat sources or sinks such as air source heat pumps, boilers, or the like or allowing imbalances in heating and cooling by the heat pump system. The operation of these components and/or the imbalances of heating and cooling can provide additional heat or reject additional heat, such that operation of the heat pump system causes either additional melting or heating, or additional freezing or cooling of media in the thermal energy storage tanks, thereby adding stored heating or cooling capacity to those thermal energy storage tanks.

Method 200 can optionally include determining operating parameters for operating the heat pump system at 212. The parameters can include particular times at which to perform the addition or removal of heat, for example, to use off-peak energy, to use cleaner energy sources such as solar, to exploit existing heating- or cooling-dominant operations of the heat pump system, to take advantage of particular ambient conditions such as cooler nights, warmer days, particular periods of elevated or reduced solar intensity, or the like. The parameters can include selection of particular sources or sinks for energy based on the particular characteristics and costs thereof, for example using a cold climate air source heat pump when ambient conditions would render another air source heat pump less efficient, using boilers when air source heat pumps can only offer extremely low efficiencies due to ambient conditions, and the like. The parameters determined at 212 can be determined before and/or during the operation of the heat pump system at 210. In an embodiment, the determination of the operating parameters can be performed dynamically during the operation of the heat pump system at 210, for example to account for variances from forecasts or the like.

Figure 3:
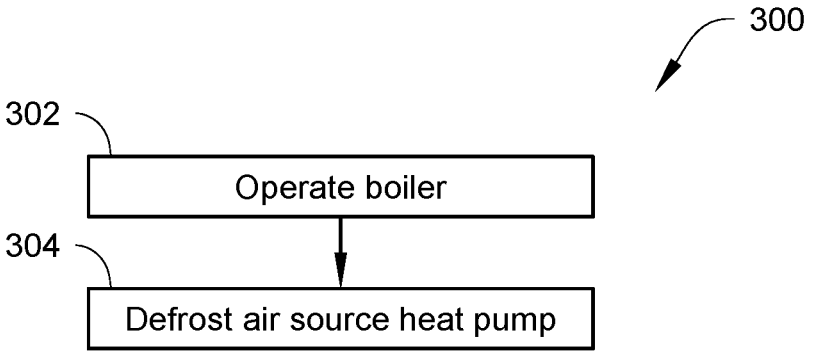
FIG. 3 shows a method of defrosting an air source heat pump of a storage source heat pump system.

FIG. 3 shows a method of defrosting an air source heat pump of a storage source heat pump system. Method 300 includes operating a boiler to temper a process fluid temperature 302 and performing a defrost operation at an air source heat pump in parallel with the boiler at 304.

A boiler is operated to temper a process fluid temperature at 302. The boiler can be operated before and/or during the defrost operation. Operation of the boiler can be at a level sufficient to maintain a temperature of the process fluid temperature, for example to accommodate for heat loss as the process fluid passes through the piping of the air source heat pump circuit 108. In an embodiment, the operation of the boiler can add at least a portion of the heat that would ordinarily be added by operation of the air source heat pump that is interrupted for the defrost operation being performed at 304. A defrost operation is performed at an air source heat pump in parallel with the boiler at 304. The air source heat pump is operated to remove frost on an outdoor heat exchanger thereof, thereby interrupting the operation of the air source heat pump to add heat to the process fluid. During the defrost operation at 304, the air source heat pump can be bypassed such that the process fluid instead flows through the boiler being operated at 304.

Aspects

It is understood that any of aspects 1-11 can be combined with any of aspects 12-17 or 18-19. It is understood that any of aspects 12-17 can be combined with any of aspects 18-19.

Aspect 1. A heat pump system, comprising:

a storage source energy transfer circuit comprising one or more thermal energy storage tanks, the storage source energy transfer circuit configured to circulate a process fluid;

a heating distribution circuit configured to circulate a heating fluid to a heating load such that the heating fluid provides heating at the heating load when in an operational mode including heating;

a cooling distribution circuit configured to circulate a fluid to a cooling load such that said fluid provides cooling at the cooling load when in an operational mode including cooling;

one or more chiller-heaters each configured to transfer heat from the process fluid to the heating fluid so as to heat the heating fluid and cool the process fluid; and an air source heat pump circuit including an air source heat pump configured to transfer heat from an ambient environment to the process fluid.

Aspect 2. The heat pump system according to aspect 1, further comprising a second air source heat pump circuit configured to exchange heat with the heating distribution circuit.

Aspect 3. The heat pump system according to any of aspects 1-2, wherein the fluid circulated by the cooling distribution circuit is the process fluid.

Aspect 4. The heat pump system according to aspect 3, further comprising one or more fluid lines configured such that the process fluid can be circulated from the air source heat pump circuit directly to the cooling distribution circuit.

Aspect 5. The heat pump system according to any of aspects 1-4, wherein the air source heat pump circuit further comprises a boiler.

Aspect 6. The heat pump system according to aspect 5, wherein the boiler is in series with the air source heat pump, and the boiler is configured to be operated during a defrost operation of the air source heat pump.

Aspect 7. The heat pump system according to any of aspects 1-6, wherein the air source heat pump circuit further comprises a second air source heat pump, the second air source heat pump being a cold climate heat pump configured to provide energy to transfer heat from the ambient environment to the process fluid when an ambient temperature is below 0° Fahrenheit.

Aspect 8. The heat pump system according to aspect 7, further comprising a controller configured to perform charging of the one or more thermal energy storage tanks based on an ambient temperature and a cost of electrical energy, wherein performing charging includes selecting one or more heat sources from the air source heat pump, the second air source heat pump, and one or more boilers.

Aspect 9. The heat pump system according to aspect 8, wherein performing charging further includes determining a timing for operating at least one of the one or more heat sources.

Aspect 10. The heat pump system according to any of aspects 1-9, further comprising a heat recovery chiller configured to exchange energy between the fluid of the cooling distribution circuit and the heating fluid.

Aspect 11. The heat pump system according to any of aspects 1-10, wherein the heating distribution circuit further comprises a boiler configured to supply heat to the heating fluid.

Aspect 12. The heat pump system according to any of aspects 1-11, further comprising a controller configured to control operation of the air source heat pump based on a temperature of the process fluid.

Aspect 13. A method of charging thermal storage in a heat pump system further including a first air source heat pump, comprising:

obtaining, at a controller, ambient conditions;

obtaining, at the controller, a cost and/or carbon intensity of energy;

determining, using the controller, a cost of adding or removing heat from the thermal storage of the heat pump system based on the ambient conditions, the cost and/or carbon intensity of energy, and performance characteristics of the heat pump system;

determining, based on the cost of adding heat to the thermal storage, whether to add or remove heat from the thermal storage;

when it is determined to add or remove heat to the thermal storage, operating the heat pump system so as to add or remove the heat from the thermal storage.

Aspect 14. The method according to aspect 13, further comprising determining operating parameters for operating the heat pump system so as to add or remove heat to the thermal storage, wherein the operating parameters include a time at which to operate the first air source heat pump of the heat pump system, and a capacity at which to operate the first air source heat pump.

Aspect 15. The method according to any of aspects 13-14, wherein the storage source heat pump system further includes a second air source heat pump, the second air source heat pump configured to provide heat at ambient temperatures between 0° F. and −30° F., and wherein determining the cost of adding or removing heat includes determining a first cost of adding heat using the first air source heat pump and a second cost of adding heat using the second air source heat pump.

Aspect 16. The method according to any of aspects 13-15, wherein the storage source heat pump system further includes a boiler, and wherein determining the cost of adding or removing heat includes determining a first cost of adding heat using the first air source heat pump and a second cost of adding heat using the boiler.

Aspect 17. The method according to aspect 16, wherein the boiler is an electric boiler.

Aspect 18. The method according to aspect 16, wherein the boiler is a fossil fuel boiler.

Aspect 19. A method of defrosting an air source heat pump of a storage source heat pump system, comprising operating a boiler so as to temper a process fluid temperature of the storage source heat pump system during a defrost operation of said air source heat pump, wherein the boiler is in parallel with the air source heat pump with respect to flow of a process fluid of the storage source heat pump system.

Aspect 20. The method according to aspect 19, wherein the boiler is an electric boiler.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A heat pump system, comprising:

a storage source energy transfer circuit comprising one or more thermal energy storage tanks, the storage source energy transfer circuit configured to circulate a process fluid;

a heating distribution circuit configured to circulate a heating fluid to a heating load such that the heating fluid provides heating at the heating load when in an operational mode including heating;

a cooling distribution circuit configured to circulate the process fluid to a cooling load such that said process fluid provides cooling at the cooling load when in an operational mode including cooling;

one or more chiller-heaters each configured to transfer heat from the process fluid to the heating fluid so as to heat the heating fluid and cool the process fluid; and an air source heat pump circuit including an air source heat pump configured to transfer heat from an ambient environment to the process fluid, wherein the air source heat pump circuit is configured to circulate the process fluid from the air source heat pump circuit to the cooling distribution circuit and/or to add heat to the process fluid to add heat to the heating fluid of the heating distribution circuit.

2. The heat pump system of claim 1, further comprising a second air source heat pump circuit configured to directly exchange heat with the heating distribution circuit.

3. The heat pump system of claim 1, further comprising a heat recovery chiller configured to exchange energy between the fluid of the cooling distribution circuit and the heating fluid.

4. The heat pump system of claim 1, wherein the heating distribution circuit further comprises a boiler configured to supply heat to the heating fluid.

5. The heat pump system of claim 1, further comprising a controller configured to control operation of the air source heat pump based on a temperature of the process fluid.

6. The heat pump system of claim 1, wherein the air source heat pump circuit further comprises a boiler.

7. The heat pump system of claim 6, wherein the boiler is in series with the air source heat pump, and the boiler is configured to be operated during a defrost operation of the air source heat pump.

8. The heat pump system of claim 1, wherein the air source heat pump circuit further comprises a second air source heat pump, the second air source heat pump being a cold climate heat pump configured to provide energy to transfer heat from the ambient environment to the process fluid when an ambient temperature is below 0° Fahrenheit.

9. The heat pump system of claim 8, further comprising a controller configured to perform charging of the one or more thermal energy storage tanks based on an ambient temperature and a cost and/or carbon intensity of electrical energy, wherein performing charging includes selecting one or more heat sources from the air source heat pump, the second air source heat pump, and one or more boilers.

10. The heat pump system of claim 9, wherein performing charging further includes determining a timing for operating at least one of the one or more heat sources.

11. A method of charging thermal storage in a storage source heat pump system according to claim 1, further including a first air source heat pump, comprising:

obtaining, at a controller, ambient conditions;

obtaining, at the controller, a cost and/or carbon intensity of energy;

determining, using the controller, a cost of adding or removing heat from the thermal storage of the heat pump system based on the ambient conditions, the cost and/or carbon intensity of energy, and performance characteristics of the heat pump system;

determining, based on the cost and/or carbon intensity of adding heat to the thermal storage, whether to add or remove heat from the thermal storage;

when it is determined to add or remove heat to the thermal storage, operating the heat pump system so as to add or remove the heat from the thermal storage.

12. The method of claim 11, further comprising determining operating parameters for operating the heat pump system so as to add or remove heat to the thermal storage, wherein the operating parameters include a time at which to operate the first air source heat pump of the heat pump system, and a capacity at which to operate the first air source heat pump.

13. The method of claim 11, wherein the storage source heat pump system further includes a second air source heat pump, the second air source heat pump configured to provide heat at ambient temperatures between 0° F. and −30° F. and wherein determining the cost of adding or removing heat includes determining a first cost of adding heat using the first air source heat pump and a second cost of adding heat using the second air source heat pump.

14. The method of claim 11, wherein the storage source heat pump system further includes a boiler, and wherein determining the cost of adding or removing heat includes determining a first cost of adding heat using the first air source heat pump and a second cost of adding heat using the boiler.

15. The method of claim 14, wherein the boiler is an electric boiler.

16. The method of claim 14, wherein the boiler is a fossil fuel boiler.

17. A method of defrosting an air source heat pump of a storage source heat pump system according to claim 1, comprising operating a boiler so as to temper a process fluid temperature of the storage source heat pump system during a defrost operation of said air source heat pump, wherein the boiler is in parallel with the air source heat pump with respect to flow of a process fluid of the storage source heat pump system.

18. The method of claim 17, wherein the boiler is an electric boiler.

* * * * *